United States Patent [19]

Tagawa et al.

[11] Patent Number: 4,839,691

[45] Date of Patent: Jun. 13, 1989

[54] IMAGE FORMING APPARATUS

[75] Inventors: Hajime Tagawa, Kawasaki; Koji Yukinaga, Tokyo, both of Japan

[73] Assignee: Kabushiki Kaisha Toshiba, Kawasaki, Japan

[21] Appl. No.: 15,614

[22] Filed: Feb. 17, 1987

[30] Foreign Application Priority Data

Mar. 31, 1986 [JP] Japan ..... 61-72997
Mar. 31, 1986 [JP] Japan ..... 61-72998

[51] Int. Cl.[4] ..... G03G 15/08

[52] U.S. Cl. ..... 355/260; 222/DIG. 1; 355/245

[58] Field of Search ..... 355/3 R, 3 DD, 14 D; 118/644, 658; 222/DIG. 1; 439/296–297, 374, 378–379, 680, 372

[56] References Cited

U.S. PATENT DOCUMENTS

| | | | |
|---|---|---|---|
| 3,184,705 | 5/1965 | Obert et al. | 439/680 |
| 3,736,053 | 5/1973 | Shreeve et al. | 355/3 |
| 3,924,944 | 12/1975 | Smith et al. | 355/3 DD |
| 4,132,476 | 1/1979 | Wetzel | 355/3 DD |
| 4,155,638 | 5/1979 | Blitzer | 355/3 DD |
| 4,256,356 | 3/1981 | Roth | 439/296 X |
| 4,271,786 | 6/1981 | Buckley et al. | 118/657 X |
| 4,284,311 | 8/1981 | Forster et al. | 439/378 X |
| 4,523,834 | 6/1985 | Pelda et al. | 355/3 DD |
| 4,583,832 | 4/1986 | Kasamura et al. | 355/3 DD |
| 4,614,389 | 9/1986 | Albert et al. | 439/374 X |
| 4,718,858 | 1/1988 | Godfrey et al. | 439/296 |

FOREIGN PATENT DOCUMENTS

| | | | |
|---|---|---|---|
| 3240026 | 5/1983 | Fed. Rep. of Germany . | |
| 3335659 | 4/1984 | Fed. Rep. of Germany . | |
| 2953572 | 11/1987 | Fed. Rep. of Germany . | |
| 57-115573 | 7/1982 | Japan | 355/3 DD |

*Primary Examiner*—Arthur T. Grimley
*Assistant Examiner*—Jane K. Lau
*Attorney, Agent, or Firm*—Cushman, Darby & Cushman

[57] ABSTRACT

In an image forming apparatus which tranfers a toner image to a sheet in accordance with image information, a first connector, is fixed to the outside of a developing device which supplies a developing agent to the apparatus. The first connector electrically connects the body and the developing device. A second connector, adapted to be connected to the first connector, is fixed to a mounting portion for holding the developing device in the apparatus. When the developing device is attached to the mounting portion, the first and second connectors are connected to each other. The apparatus also includes a movable handle which would or would not allow a removable lid to fully close.

8 Claims, 10 Drawing Sheets

IMAGE FORMING APPARATUS

BACKGROUND OF THE INVENTION

1. Field of the Art

The present invention relates to image forming apparatuses used to transfer a toner image to paper sheets, thereby forming a visible image thereon.

2. Background of the Prior Art

Conventional image forming apparatuses of this type include the so-called electronic copying machines, laser printers, etc. These apparatuses are provided with a photosensitive drum, for use as an image carrier, an apparatus body for forming an electrostatic latent image on the drum, and a developing device for supplying a toner to the latent image, thereby developing the image. Developing devices of the so-called cassette type have recently started to be used. These developing devices, are formed independently of the apparatus body and are adapted to be removably attached to a mounting portion of the body by one-step operation.

When using one such cassette-type developing device, it must be located accurately in position. The reason is that if the distance between the photosensitive drum and a developing roller for supplying the toner is only a little longer than a predetermined distance, the toner sometimes cannot be supplied fully to the drum, thus failing to providing a clear image. If the developing roller is located too close to the drum, on the other hand, the toner will be supplied excessively, and in an extreme case, the delicate photosensitive drum will possibly be damaged.

Meanwhile, the developing device is provided with connectors through which signals for controlling the drive of a developer feed roller or the toner content of a developing agent are transferred for output or input. After the developing device is attached to the mounting portion of the apparatus body, the connectors, fixed individually to the body and the developing device, are connected manually to each other.

If the developing device is not located in its correct position or is tilted an operator sometimes may couple the connectors without noticing the situation. In such a case, the image obtained may be defective and the apparatus may be damaged.

Moreover, the operator may commit a wrong operation such that the developing device is mounted without connecting the connectors.

SUMMARY OF THE INVENTION

The object of the present invention is to provide an image forming apparatus which is substantially protected against an operator's erroneous operation and can be prevented from producing defective images and from being damaged.

The above object of the invention is achieved by connecting connectors only when a developing device is mounted in a correct position on a mounting portion.

According to an aspect of the present invention, there is provided an image forming apparatus which transfers a developing agent to a sheet in accordance with image information, which comprises a body including an image carrier on which an electrostatic latent image is formed; a developing device for supplying the developing agent to the image carrier, thereby developing the latent image; a first connector fixed to the outside of the developing device, for electrically connecting the developing device and the body; a mounting portion provided in the body so as to face the image carrier, whereby the developing device is removably held in place; and a second connector fixed to the mounting portion, and adapted to be connected to the first connector when the developing device is attached to the mounting portion.

DETAILED DESCRIPTION OF THE PREFERRED EMBODIMENT

An embodiment of the present invention will now be described in detail with reference to the accompanying drawings of FIGS. 1 to 15.

Figure 1:
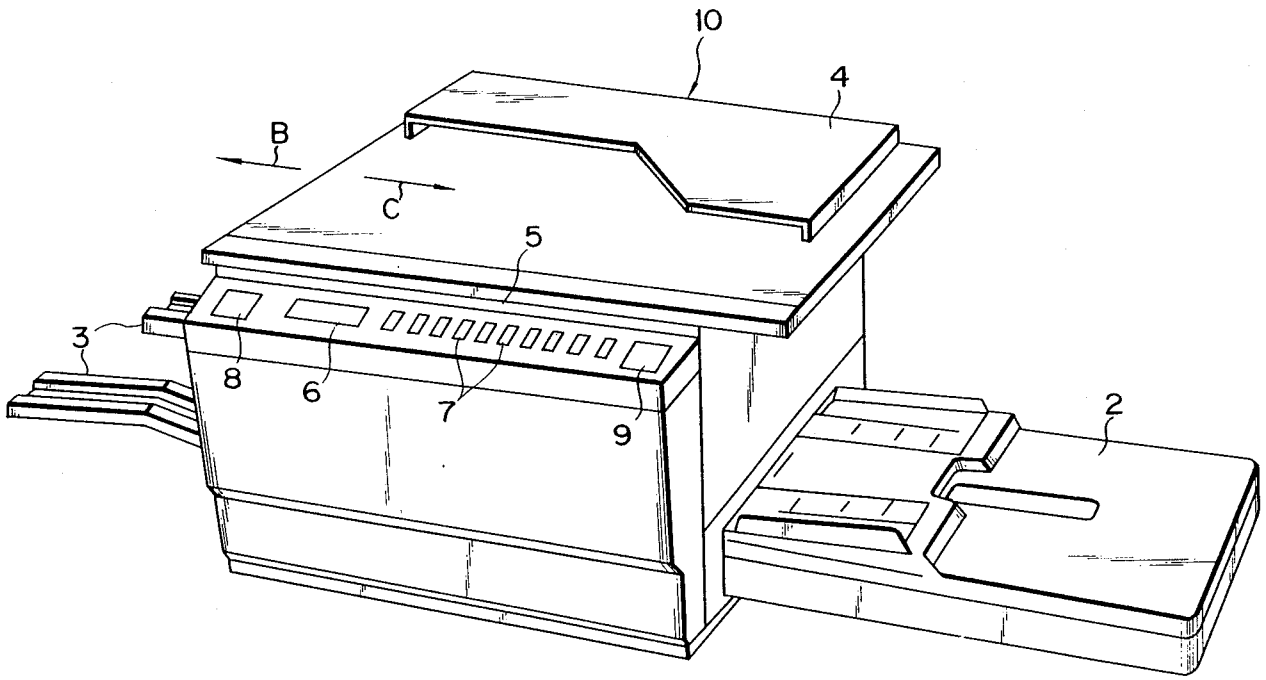
FIG. 1 is a perspective view of an electronic copying machine, as an image forming apparatus according to an embodiment of the present invention.

As shown in FIG. 1, paper cassette 2 for automatic or manual paper feed is removably attached to the right-hand side portion of electronic copying machine 10 according to the embodiment of the present invention. On the other hand, tray 3 is attached to the left-hand side portion of the copying machine, whereby copies are received. Original table 4, used to carry an original, is mounted on the top of machine 10. It can reciprocate from side to side or in the directions indicated by arrows B and C. In FIG. 1, numeral 5 designates a control panel for controlling the copying machine. Panel 5 is composed of display panel 6 for indicating operating states or instructions, such as "no paper" and "resupply toner," ten-keys 7, exposure setting key 8 used to start exposure, print key 9 used to start copying operation, etc.

Figure 2:
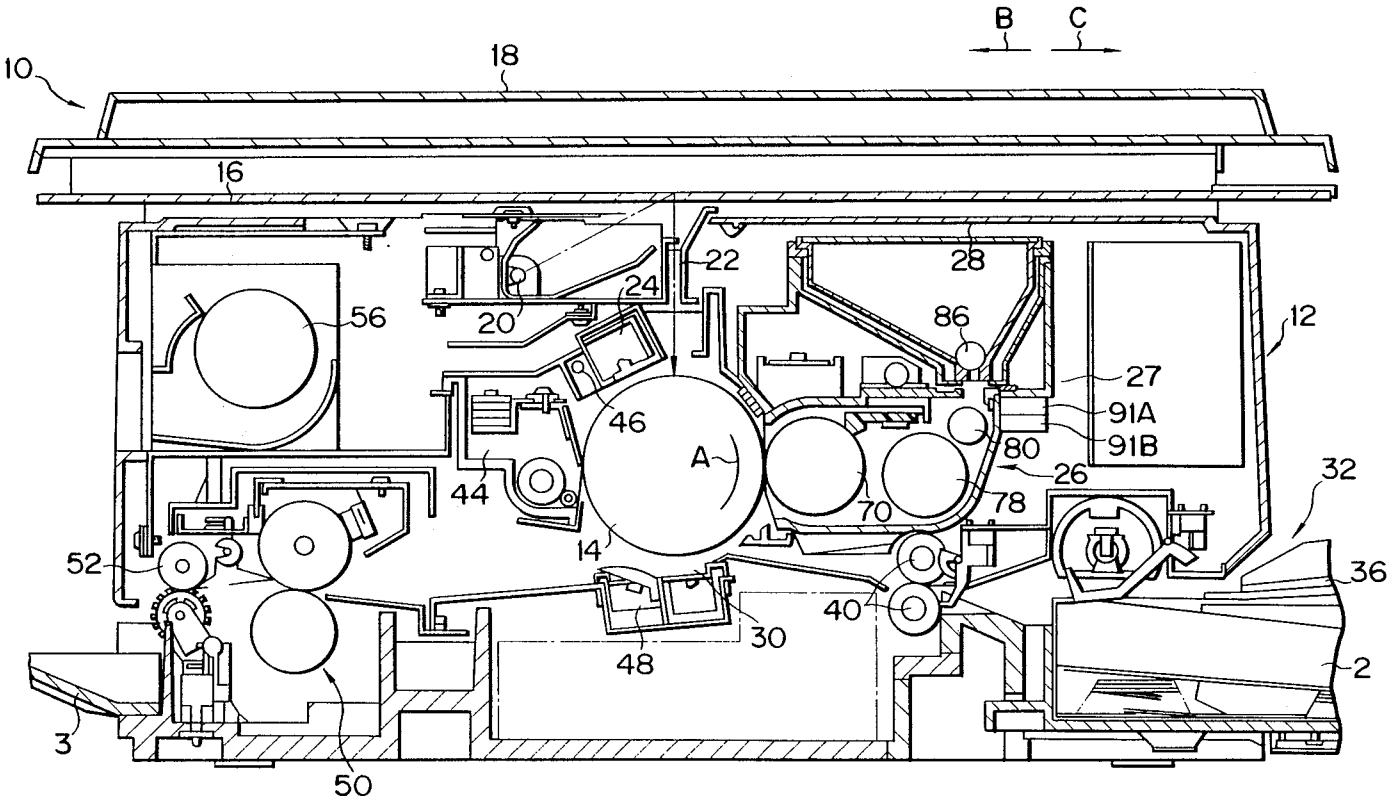
FIG. 2 is a schematic sectional view of the copying machine shown in FIG. 1.
Figure 3:
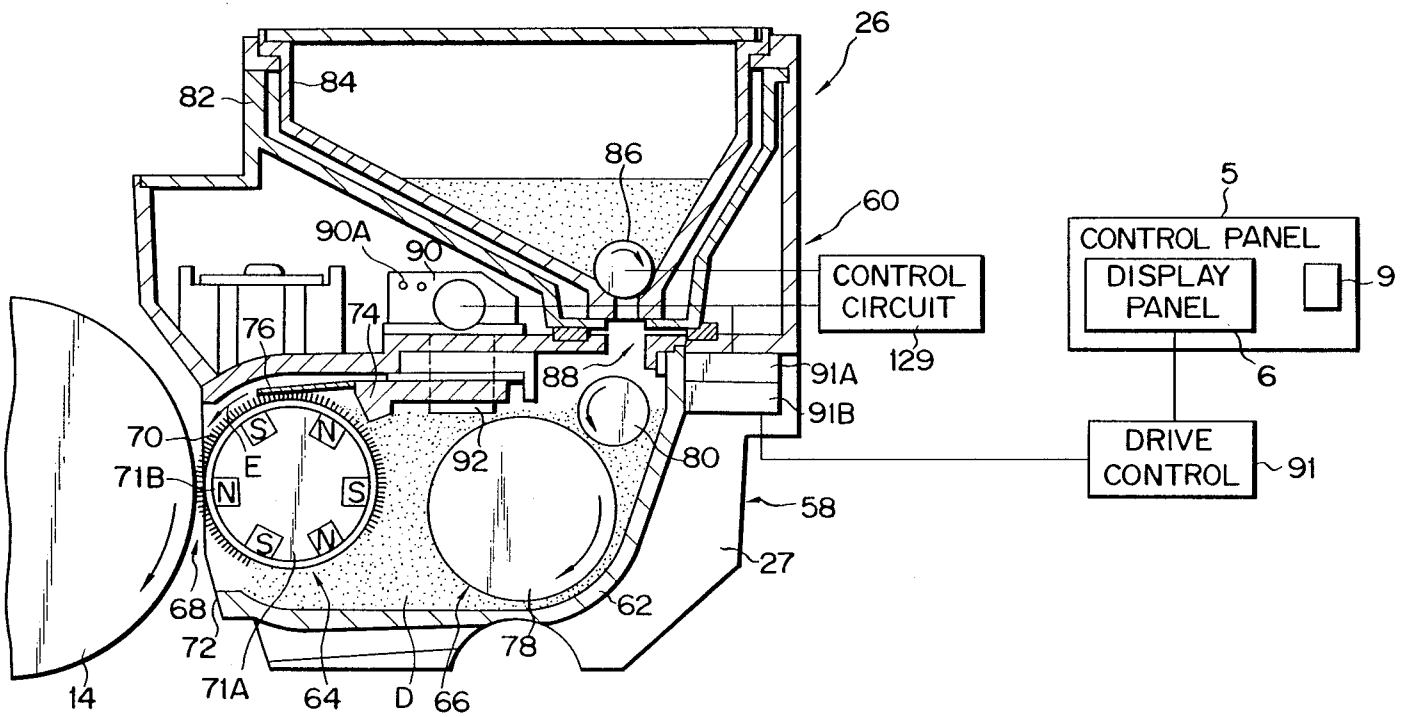
FIG. 3 is a schematic sectional view of a developing device shown in FIG. 2.

In copying machine 10, as shown in FIG. 2, photosensitive drum 14, for use as an image carrier, is located substantially in the center of housing 12. During copying operation, drum 14 rotates in the direction indicated by arrow A.

Original table 16, made of transparent glass, is provided on top of housing 12. Supporting an original document thereon, it can reciprocate in the directions of arrows B and C. Original cover 18 is hinge-mounted on table 16. As table 16 is moved in synchronism with the rotation of photosensitive drum 14, a light emitted from exposure lamp 20 is reflected by the original on table 16. The reflected light is projected on the peripheral surface of drum 14 by convergent-light transmitter 22, such as a rod lens. Meanwhile, the surface of drum 12 is charged with electricity, by main charger 24. When the light is applied to the drum surface, charged in this manner, an electrostatic latent image is formed on the surface. A toner is attached to the latent image, to form a toner image, by developing device 26 which faces the peripheral surface of drum 14.

Developing device 26 is removably attached to mounting portion 27, which is formed in housing 12, so that it can be replaced with another developing device which contains a developing agent of another color. In loading or unloading the developing device, lid 28, hinge-mounted at the top portion of housing 12, is lifted.

Paper feed unit 32 is removably attached to the lower right side of housing 12, as shown in FIG. 2. It serves to feed paper sheets to image-transfer section 30, under photosensitive drum 14. The feed unit is fitted with paper cassette 2 (shown in FIG. 1), storing a plurality of sheets, and sheet-bypass guide 36 for manual paper feed, located on top of cassette 2. Further, unit 32 is provided with paper-supply roller 38, used to deliver the sheets from cassette 2, and a pair of aligning rollers 40, whereby each delivered sheet is stopped temporarily. Rollers 40 serve to align the leading edge of the sheet, and time the sheet feed to the transport of the toner image, on the peripheral surface of drum 14.

The sheet, transport by aligning rollers 40, is delivered to image-transfer section 30. Thereupon, it is brought closely into contact with the surface of photosensitive drum 14, by transfer charger 42. As the sheet is then charged by charger 42, the toner image on drum 14 is transferred to the sheet. After the transfer, drum 14 is cleared of the residual toner on its surface by cleaner 44, and a residual image is removed by discharge lamp 46, whereupon an entire cycle of copying operation is completed. The sheet, after the transfer, is separated from drum 14 by separation charger 48, and fed to fixing unit 50. As the sheet passes unit 50, the toner image, transferred thereto, is fixed thermally. After the fixation, the sheet is discharged into tray 3 via exit rollers 52. In FIG. 2, numeral 56 designates a cooling fan for preventing a temperature rise.

Referring now to FIGS. 3 and 6 to 10, developing device 26 will be described in detail. It comprises stirrer unit 58, for stirring the developing agent and feeding the toner to photosensitive drum 14, and replenishing unit 60, located over unit 58 and adapted to resupply the toner to unit 58.

Stirrer unit 58 includes developing-agent feeder section 64 for feeding the developing agent in casing 62 to photosensitive drum 14, and developing-agent stirring section 66 for mixing the toner, supplied from replenishing unit 60, with the developing agent in casing 62 and stirring the resulting mixture. Section 64 is provided with developing roller 70 for forming a magnetic brush of the developing agent, on the peripheral surface of drum 14, and transporting the brush to developing region 68, which faces drum 14. Roller 70 is formed of magnetic roll 71A having five pole portions, and rotating sleeve 71B fitted on roll 71A and rotating in a counterclockwise direction, as indicated by an arrow E in FIG. 3.

Rotating sleeve 71B is in a so-called "with" mode such that it is rotated in the same direction as the rotating direction of photosensitive drum 14, for development. Thus, the developing-agent brush, held on the surface of sleeve 71B, is in sliding contact with the image on drum 14, following the flow of the image. Thus, a sufficient developing time can be secured, and the electrostatic latent image, formed on drum 14, can enjoy high quality.

Corresponding to developing region 68, opening 72 is formed in casing 62. Doctor blade 74 is located over developing roller 70, whereby the thickness of the magnetic brush is regulated. From the tip end of blade 74 extends thin plate 76, which levels the brush, regulated by blade 74.

Stirring section 66 adjoins developing-agent feeder section 64. Section 66 includes main stirring roller 78 and sub-roller 80 located above roller 78. The developing agent is dropped from replenishing unit 60 onto sub-roller 80.

Replenishing unit 60 is fitted with toner hopper 84, which is removably mounted on top portion 82 of casing 62. Feed roller 86 is disposed at the bottom of hopper 84, whereby the toner in the hopper is fed into stirrer unit 58. In response to the rotation of roller 86, the toner is taken out of hopper 84. In this case, the amount of toner delivered from hopper 84 is controlled in accordance with the rotation of roller 86. Passage 88 is formed under roller 86. Units 58 and 60 connect with each other by means of passage 88, so that the toner drops from hopper 84 onto sub-roller 80 through passage 88. Further, replenishing unit 60 contains toner-content detector 90, which detects the toner content of the developing agent in stirrer unit 58. Detector 90 is connected to connector 91A, which is fixed to the substantially central portion of the back of casing 62 of developing device 26. Connector 91B is fixed to mounting portion 27 of housing 12. Connectors 91A and 91B are located in corresponding positions so that they are connected to each other when the developing device is attached to mounting portion 27. Connector 91B is connected to drive control 91 for controlling the whole copying machine. As connectors 91A and 91B are connected, signals, indicative of the presence of the developing device, the color and toner density of the developing agent, etc., as well as electrical signals for driving detector 90, are transmitted.

Further, drive control 91 is connected to control panel 5. Appropriate messages, such as "resupply toner" and "black developing," are indicated on display panel 6 in accordance with signals, indicative of the presence of the developing device, the color and toner content of the developing agent in the device, etc., delivered from toner-content detector 90 via connectors 91A and 91B. If connectors 91A and 91B are not connected, print key 9 of control panel 5 is prevented from being operated for input.

Figure 7:
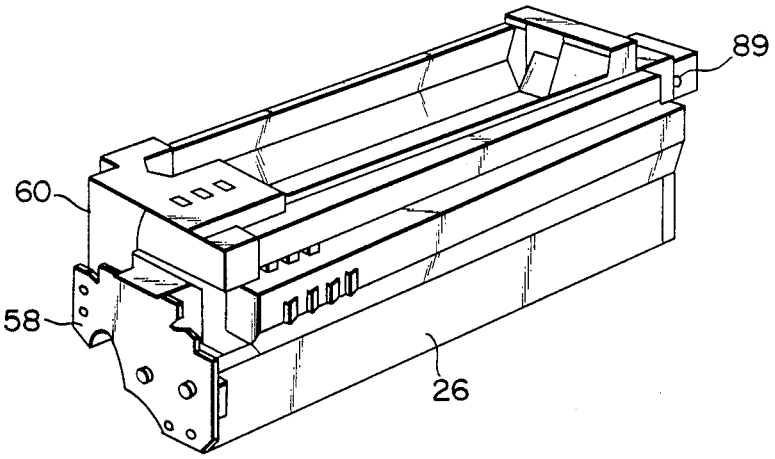
FIG. 7 is a perspective view of the developing device shown in FIG. 6.
Figure 13:
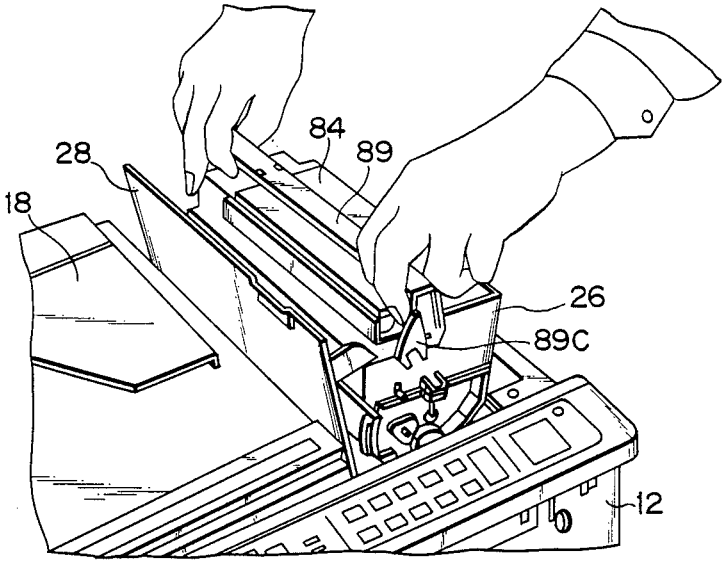
FIG. 13 is a perspective view for illustrating the way the developing device is loaded into the electronic copying machine.
Figure 15:
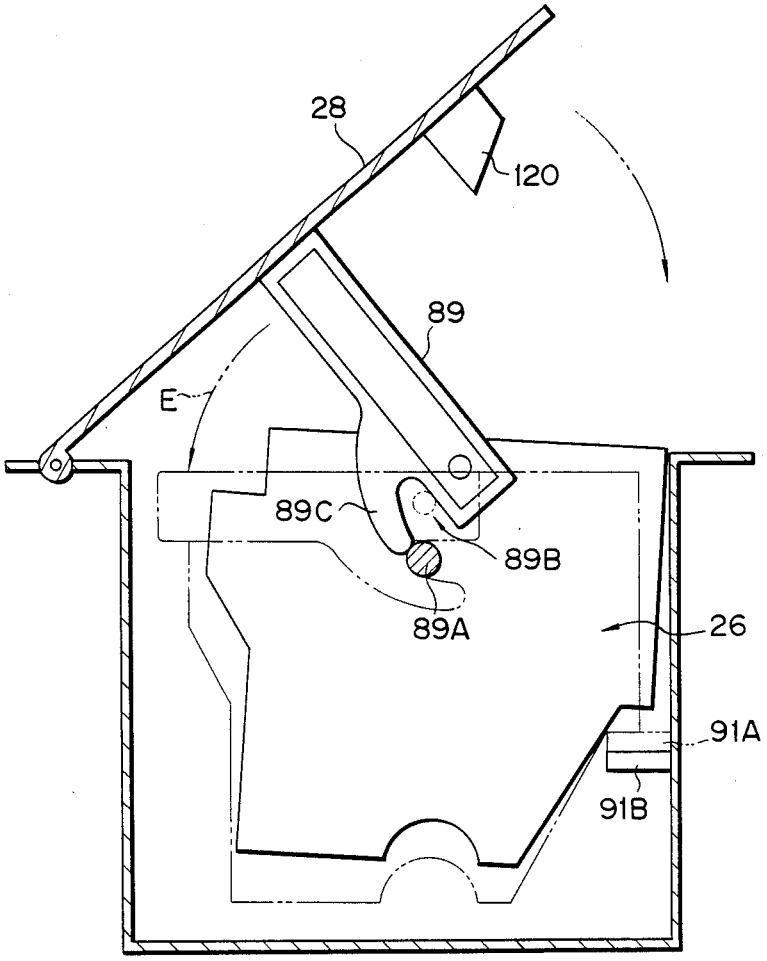
FIG. 15 is a schematic sectional view for illustrating the way the developing device is attached to the mounting portion of the body of the electronic copying machine.

As shown in FIG. 7, moreover, handle 89 is attached to the upper portion of replenishing unit 60. In transporting developing device 26, for example, to mount it in housing 12, the operator can hold the device by handle 89. The handle is swingable relatively to the body of replenishing unit 60, and is laid down after device 26 is set in position in housing 12. In carrying device 26 for loading or unloading, as shown in FIG. 13, the laid handle is raised substantially upright. When handle 89 is in the laid position, it is substantially flush with top portion 82 of casing 62. Hook 89C is attached to one side portion of handle 89. It is formed with notch 89B adapted to engage projection 89A, which protrudes from one side wall of mounting portion 27. Only when developing device 26 is located accurately in position, hook 89C can engage projection 89A so that the projection is fitted in notch 89B, thus allowing handle 89 to be laid down, as shown in FIG. 15. In this manner, device 26 is locked to mounting portion 27.

Moreover, detector 90 is provided with indicating lamp 90A, which glows when the developing agent content is within an allowable error.

Content detector 90 determines the toner content of the developing agent by measuring the permeability of the developing agent. Since the developing agent is formed of a magnetic carrier and the toner, which is a nonmagnetic substance, the permeability of the agent varies, depending on the toner density. More specifically, magnetic sensor head 92 is immersed in the developing agent in stirrer unit 58, thus detecting a change of the permeability. The permeability change is converted into a change of voltage, and the toner content corresponding to the voltage change is detected.

When emptied, toner hopper 84, which is of a cartridge type, is replaced with a new one, full of toner.

Figure 4:
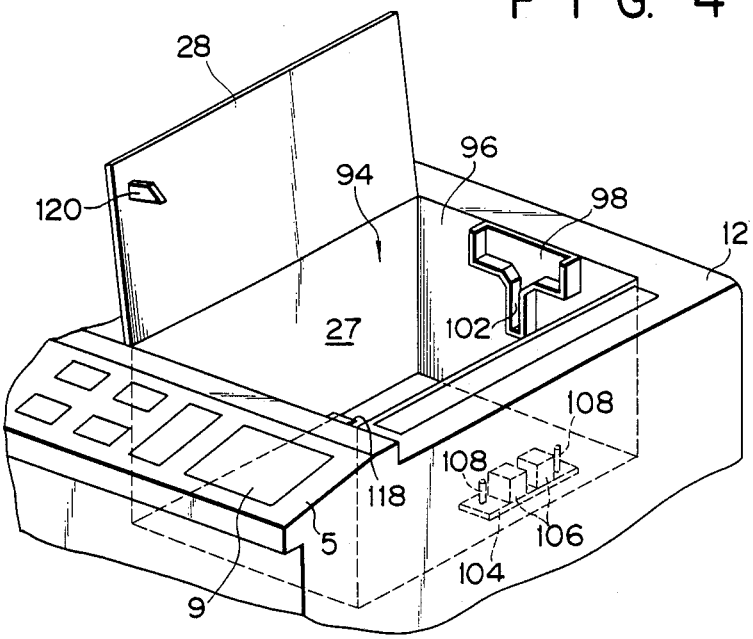
FIG. 4 is a perspective view showing a mounting portion of the developing device.
Figure 5:
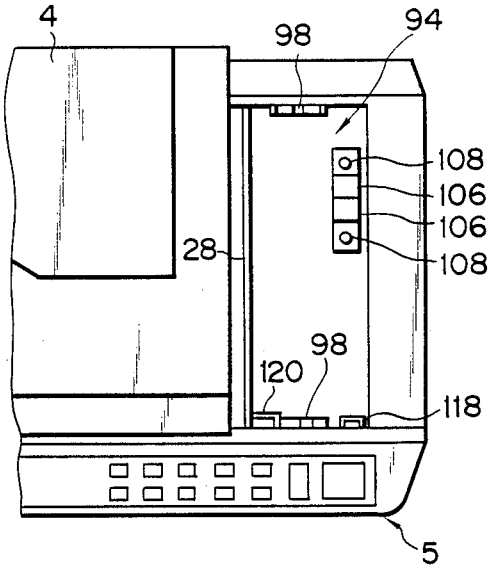
FIG. 5 is a plan view of the mounting portion shown in FIG. 4.
Figure 6:
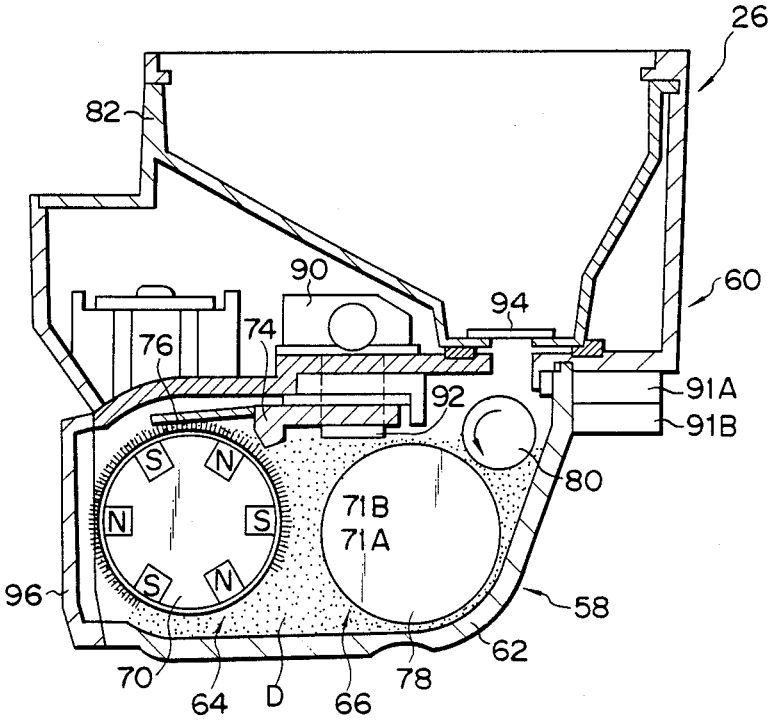
FIG. 6 is a schematic sectional view showing the developing device.

Referring now to FIGS. 4 and 5, mounting portion 27 for removably holding developing device 26 will be described. Portion 27 is formed with holding space 94 in which device 26 is housed. Space 94 faces photosensitive drum 14. Connector 91B is fixed to one side portion of the bottom of portion 27. As shown in detail in FIG. 14, base 104 of connector 91B is fixed to mounting portion 27 by means of screws 103. A pair of connecting members 106 stand upright on base 104, and guide pins 108 for deciding the position of the connecting members 106, having a conical head, are set up outside their corresponding members 106. The head of each pin 108 projects above members 106. A plurality of terminals 110 for electrical connection are arranged at the top portion of each connecting member 106. On the other hand, connector 91A of developing device 26, which is to be connected to connector 91B, is formed with a pair of recesses 112, in which connecting members 106 of developing device 26 are fitted individually. Connector 91A is also formed with holes 114, arranged across recesses 112. Guide pins 108 are adapted to be fitted in their corresponding holes 114. Second terminals 116 are formed at the bottom of each recess 112. When connecting members 106 are fitted in recesses 112, terminals 116 are brought into contact with their corresponding terminals 110.

Figure 8:
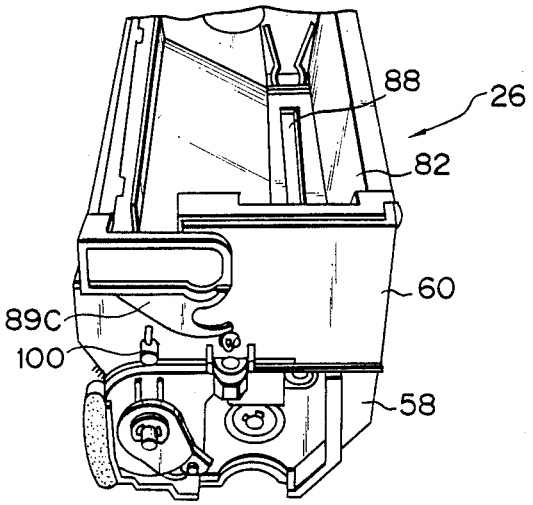
FIG. 8 is a perspective view of the developing device shown in FIG. 7, as taken in another direction.
Figure 9:
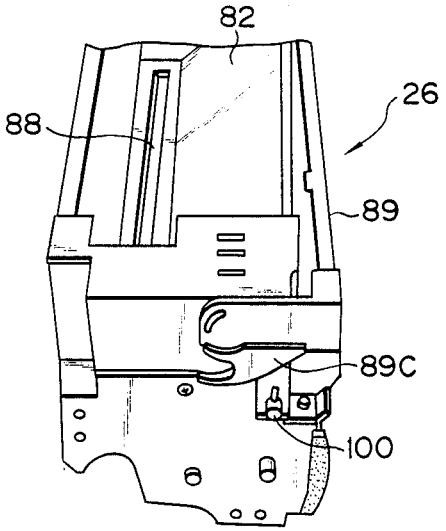
FIG. 9 is a perspective view of the developing device shown in FIG. 7, as taken in still another direction.
Figure 10:
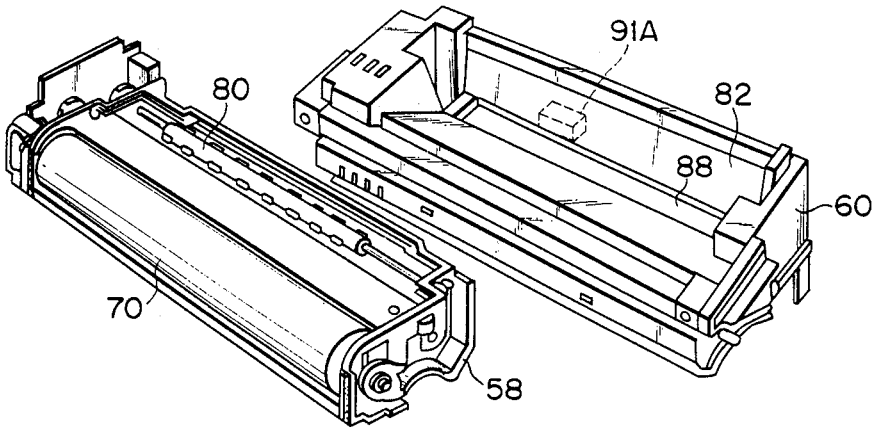
FIG. 10 is an exploded perspective view of the developing device, in which upper and lower units are separated from each other.

As mentioned before, connector 91B is fixed to the both side portion of the bottom of mounting portion 27. Guide member 98 is attached to each of a pair of side walls 96 of mounting portion 27, facing each other. Members 98 help developing device 27 to be mounted in place. Each guide member 98 is formed with groove 102, which engages each corresponding locating pin 100 for the developing device. Pin 100, as shown in FIGS. 8 and 9, protrudes from each side of the developing device. The width of groove 102 is reduced with distance from its upper end. At its lower end portion, groove 102 has a width such that pin 100 is slidably fitted in the groove without a gap.

Detector 118 is attached to one of side walls 96, in the vicinity of its corresponding guide member 98. The detector 118 detects lid 28 in its on-position. Corresponding in position to detector 118, protrusion 120 protrudes from lid 28. In this arrangement, when member 102 engages detector 118, it activates a switch in the detector. Thus, the detector appreciates that holding space 94 is closed by lid 28.

Figure 11:
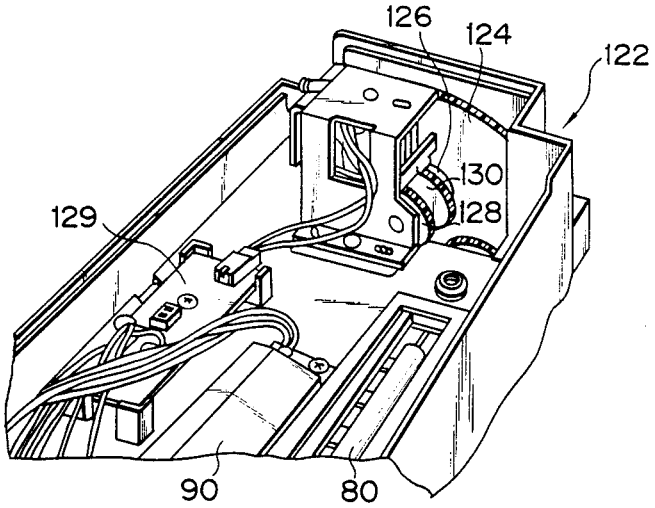
FIG. 11 is a perspective view showing a drive mechanism of the developing device.
Figure 12:
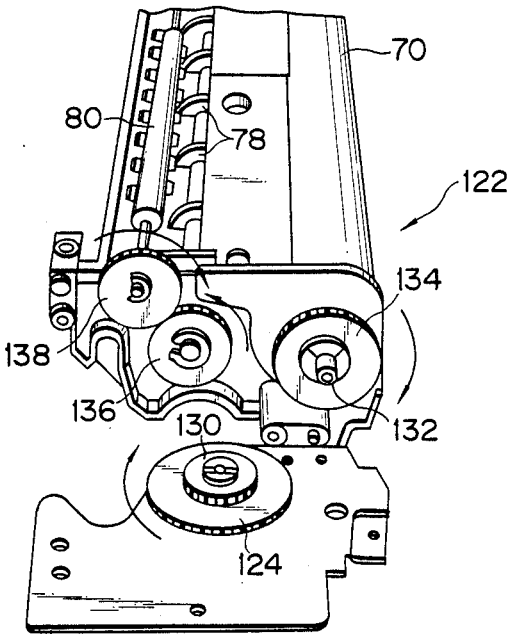
FIG. 12 is an exploded perspective view for illustrating the drive mechanism of FIG. 11, in detail.

Referring now to FIGS. 11 and 12, drive mechanism 122 for developing device 26 will be described.

Drive mechanism 122 includes first gear 124, which engages a driving gear (not shown), attached to housing 12, when developing device 26 is mounted in the housing. Gear 124 is coupled to second gear 128 by means of clutch 126. Gear 128 is in mesh with a gear of feed roller 86 in toner hopper 84, shown in FIG. 3. Clutch 126 is connected to toner-content detector 90 by means of control circuit 129, so that it is engaged or disengaged in response to a detection signal from detector 90.

Meanwhile, first gear 124 is coupled with third gear 130 for joint rotation. As shown in FIG. 12, gear 130 is in mesh with fourth and fifth gears 134 and 136, which are fixed to shaft 132 of developing roller 70 and a shaft of main stirring roller 78, respectively. Gear 136 is in mesh with sixth gear 136 fixed to a shaft of sub-roller 80. Thus, as first gear 124 rotates, rollers 70, 78 and 80 rotate continually.

Figure 14:
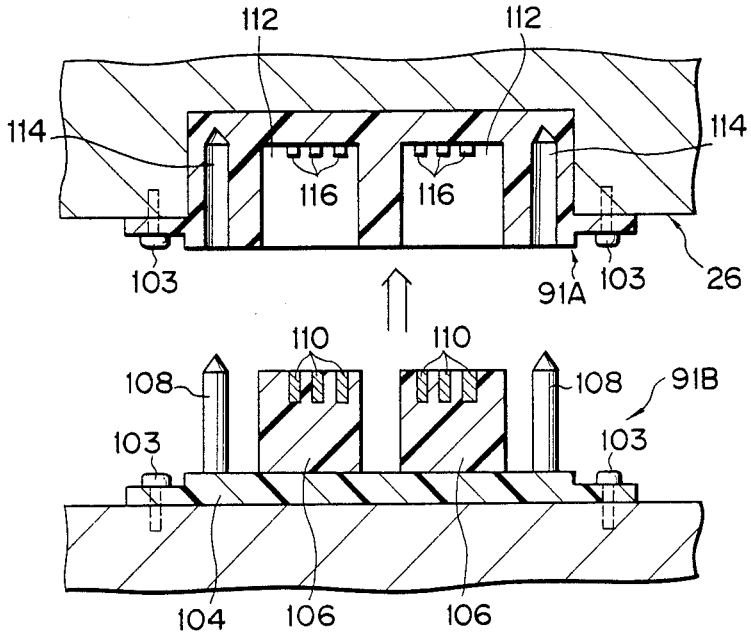
FIG. 14 is a sectional view showing connectors.

Referring now to FIGS. 13 to 15, the operation of this embodiment will be described.

In attaching developing device 26 to mounting portion 27 of machine housing 12, the operator first lifts lid 28 of the housing, and raises handle 89 of device 26, in the laid position, with both hands, as shown in FIG. 13. Then, the developing device is inserted into holding space 94 through an opening of portion 27. Thereupon, locating pins 100 of device 26 are guided into their corresponding guide members 98 in space 94. Thus, pins 100 and members 98 face and engage one another so that connectors 91A and 91B are connected properly to each other, while correcting the posture of the developing device. In connecting the connectors, guide pins 108, each having a pointed head, can be inserted easily into their corresponding holes 114. As pins 108 are fitted in holes 114 in this manner, connectors 91A and 91B face each other exactly in alignment, that is, the connectors are located in place. In this state, connecting members 106 are fitted in their corresponding recesses 112, so that terminals 116 of connector 91A are brought into contact with their corresponding terminals 110 of connector 91B. Thus, connectors 91A and 91B are coupled together.

After developing device 26 is attached to housing 12, handle 89, in the raised position, is swung in the direction of arrow E of FIG. 15, to be laid down. If device 26 is in its correct position, handle 89 can be brought into a horizontal position, where it can be housed in holding space 94, as indicated by two-dot chain line in FIG. 15. Thereafter, lid 28 is shut down, whereupon protrusion 120 switches detector 118 on. Thus, detector 118 appreciates that space 94 is closed by lid 28. When the closed state is detected in this manner, after the connection of connectors 91A and 91B, print key 9 is switched off.

If developing device 26 is not set in the correct position at mounting portion 27, as shown in FIG. 15, hook 89C of handle 89 abuts against projection 89A, so that the handle cannot be laid down to the horizontal position. Accordingly, lid 28 is prevented from being shut down, so that the operator can be readily aware that developing device 26 is not in position. If lid 28 is not shut down completely, moreover, detector 118 detects this, and "shut down lid" or the like appears on display panel 6.

Thus, according to the embodiment described above, connectors 91A and 91B can be connected securely the moment developing device 26 is mounted in place. After device 26 is attached to mounting portion 27, if handle 89 is laid down so that its hook 89C engages projection 89A of housing 12, device 26 can be locked securely to the housing. Thus, the distance between photosensitive drum 14 and developing roller 70 of developing device 26 cannot be changed, despite mechanical vibration during copying operation.

After developing device 26 is set in this manner, the copying machine is in a stand-by mode for a copying operation. If print key 9 is depressed in this state, the copying operation is started.

According to the embodiment described herein, moreover, one of the two connector in fixed to the developing device, while the other is fixed to the mounting portion. The connectors are connected to each other only when the developing device is mounted in the predetermined position. Thus, the copying machine is prevented from operating with the developing device in a wrong position.

Also, such a wrong operation can be prevented that the developing device is mounted in place without connecting the connectors.

It is to be understood that the present invention is not limited to the embodiment described above, and that various changes and modifications may be effected therein by one skilled in the art without departing from the scope or spirit of the invention.

For example, the guide pins, planted on either of the connectors, are not limited to two in number, and may be one or three or more.

Instead of being fixed to the developing device, moreover, the one connector may be attached to handle 89, for example, with the same result or effect. In this case, when handle 89 is laid down to the horizontal position, the developing device is locked, and the connectors are connected to each other.

What is claimed is:

1. An image forming apparatus which transfers a developing agent to a sheet in accordance with image information comprising:

a body;

an image carrier disposed in said body on which an electrostatic latent image is formed;

a developing device for supplying said developing agent to said image carrier to develop said latent image, said developing means including a moveable handle having a transport position and a lock position;

a first connection disposed on said developing device for electrically connecting said developing device to said body;

a mounting means disposed in said body for removably holding said developing device in a correct position relative to said image carrier;

a second connection attached to said mounting means and adapted to be connected to said first connector in a connected position when said developing device is attached to said mounting means in said correct position so that operation of said image forming apparatus can take place;

a removable lid which will fully close when said developing device is in said correct position and said handle is placed in said locked position and will not fully close when said developing device is not in said correct position and said handle is in said transport position to give a clear indication that said developing device is not in said correct position.

2. An apparatus according to claim 1 wherein said handle includes a hooked portion and further including a projection attached to said mounting means so that when said handle is in said lock position said hooked portion fits into said projection to secure said developing device in said correct position.

3. An apparatus according to claim 1 further including a detecting means for detecting when said lid is open and when said lid is closed.

4. An apparatus according to claim 1, wherein said developing device is provided with a toner-content detector for automatically detecting the toner content of said developing agent so that an output signal from said content detector is delivered to said body via said connectors.

5. An apparatus according to claim 1, wherein said mounting means further includes rough guide means for initially guiding said developing device toward said correct position.

6. An apparatus according to claim 5, wherein said rough guide means includes a guide member constituting a groove in the side wall of said mounting means, said groove being tapered gradually downward.

7. An apparatus according to claim 6, wherein said connectors are provided individually with fine guide means for further guiding said connectors into said connected position when said developing device is attached to said mounting means in said correct position.

8. An apparatus according to claim 7, wherein said guide means includes a hole formed in said first connector and a pin protruding from said second connector and adapted to be fitted in said hole.

* * * * *